US010655910B2

(12) United States Patent
Roekens et al.

(10) Patent No.: US 10,655,910 B2
(45) Date of Patent: May 19, 2020

(54) BEVERAGE COOLER WITH ENHANCED THERMOELECTRIC COOLING MODULES

(71) Applicant: The Coca-Cola Company, Atlanta, GA (US)

(72) Inventors: Jurgen Roekens, Kampenhout (BE); Gregg Carpenter, Marietta, GA (US); Roberto Horn Pereira, Suwance, GA (US); Michael Gary Izenson, Hanover, NH (US); Weibo Chen, Hanover, NH (US); Scott David Phillips, Enfield, NH (US); Christian Henry Passow, Hanover, NH (US)

(73) Assignee: The Coca-Cola Company, Atlanta, GA (US)

( * ) Notice: Subject to any disclaimer, the term of this patent is extended or adjusted under 35 U.S.C. 154(b) by 147 days.

(21) Appl. No.: 16/063,879

(22) PCT Filed: Dec. 2, 2016

(86) PCT No.: PCT/US2016/064694

§ 371 (c)(1),
(2) Date: Jun. 19, 2018

(87) PCT Pub. No.: WO2017/112391

PCT Pub. Date: Jun. 29, 2017

(65) Prior Publication Data

US 2018/0372403 A1 Dec. 27, 2018

Related U.S. Application Data

(60) Provisional application No. 62/270,684, filed on Dec. 22, 2015.

(51) Int. Cl.

| | |
|---|---|
| ***F25B 21/02*** | (2006.01) |
| ***F25D 31/00*** | (2006.01) |
| ***F28F 13/00*** | (2006.01) |

(52) U.S. Cl.

CPC ..... *F25D 31/002* (2013.01); *F25B 21/02* (2013.01); *F28F 13/00* (2013.01); *F25B 2321/0252* (2013.01)

(58) Field of Classification Search

CPC ..... F25D 31/002; F28F 13/00; F25B 21/02; F25B 2321/0252; F25B 21/00; F25B 21/04

See application file for complete search history.

(56) References Cited

U.S. PATENT DOCUMENTS 4,281,516 A * 8/1981 Berthet ..... F25B 21/02 62/3.3
5,314,586 A * 5/1994 Chen ..... C02F 1/04 202/177

(Continued)

FOREIGN PATENT DOCUMENTS

JP 2001 165479 A 6/2001
KR 20 0209762 Y1 1/2001

(Continued)

OTHER PUBLICATIONS

International Search Report and Written Opinion, PCT/US2016/064694, Mar. 3, 2017 (12 pp.).

*Primary Examiner* — Emmanuel E Duke
(74) *Attorney, Agent, or Firm* — Eversheds Sutherland (US) LLP

(57) ABSTRACT

The present application provides a cooler for cooling a beverage fluid flow. The cooler may include a thermoelectric cooling device in communication with a fluid heat exchanger with the fluid flow therein and a water permeable membrane. The cooler further may include a fan positioned about the water permeable membrane for evaporative cooling therein.

20 Claims, 8 Drawing Sheets

(56) References Cited

U.S. PATENT DOCUMENTS

| | | | | |
|---|---|---|---|---|
| 5,964,092 | A * | 10/1999 | Tozuka | A61F 7/10 62/3.7 |
| 2004/0098991 | A1* | 5/2004 | Heyes | B67D 1/0869 62/3.64 |
| 2008/0007696 | A1 | 1/2008 | Engle et al. | |
| 2008/0282705 | A1* | 11/2008 | Hue | F25D 16/00 62/3.6 |
| 2012/0312030 | A1* | 12/2012 | Lu | F25B 21/02 62/3.6 |
| 2014/0123683 | A1* | 5/2014 | Hou | F25B 21/02 62/3.6 |
| 2015/0323228 | A1* | 11/2015 | Wang | F28D 1/05366 62/3.7 |

FOREIGN PATENT DOCUMENTS

| | | | |
|---|---|---|---|
| KR | 10 0512040 | B1 | 9/2005 |
| KR | 10 2013 0143421 | A | 12/2013 |

* cited by examiner

BEVERAGE COOLER WITH ENHANCED THERMOELECTRIC COOLING MODULES

TECHNICAL FIELD

The present application and the resultant patent relate generally to beverage coolers and more particularly relate to a compact beverage cooler using enhanced thermoelectric cooling modules for rapid and efficient cooling of potable liquids and the like.

BACKGROUND OF THE INVENTION

Conventional thermoelectric cooling techniques may be used to cool a flow of a beverage or other types of fluids. Generally described, a beverage heat exchanger may be thermally coupled to a cold side of a thermoelectric cooling device and a heat sink may be thermally coupled to a hot side. Electric current flowing through the thermoelectric cooling device causes heat to be absorbed from the cold side and released on the hot side. The beverage thus may flow through the beverage heat exchanger and exchange heat therein. Ambient air may flow through the heat sink and carry away the rejected heat. The heat sink generally must be warmer than the temperature of the ambient air for efficient heat rejection. The rate of heat rejection therefore may be proportional to the difference in temperature between the hot side of the thermoelectric cooling device and the ambient air.

Issues with known thermoelectric cooling devices include the fact that the cooling generated by the thermoelectric cooling devices may decrease as the hot/cold temperature difference increases. For example, there may be little to no cooling capability once the hot/cold temperature difference is greater than, for example, about fifty degrees Celsius (50° C.) or so. The efficiency and the amount of power consumed by a conventional thermoelectric cooling device also may be an issue.

SUMMARY OF THE INVENTION

The present application and the resultant patent thus provide a cooler for cooling a beverage fluid flow. The cooler may include a thermoelectric cooling device in communication with a fluid heat exchanger with the fluid flow therein and a water permeable membrane for evaporative cooling therein. The cooler further may include a fan positioned about the water permeable membrane.

The present application and the resultant patent further may provide a method of cooling a fluid. The method may include the steps of flowing the fluid on a cold side of a thermoelectric cooling device, flowing an evaporant through a water permeable membrane on a hot side of the thermoelectric cooling device to pull heat therefrom, blowing air across the water permeable membrane, and pulling heat from the fluid across the thermoelectric cooling device.

The present application and the resultant patent further may provide a beverage cooler for cooling a beverage fluid flow. The beverage cooler may include a number of thermoelectric cooling modules having a water permeable membrane, a pump in communication with the thermoelectric cooling modules, and a fan positioned about the thermoelectric cooling modules.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
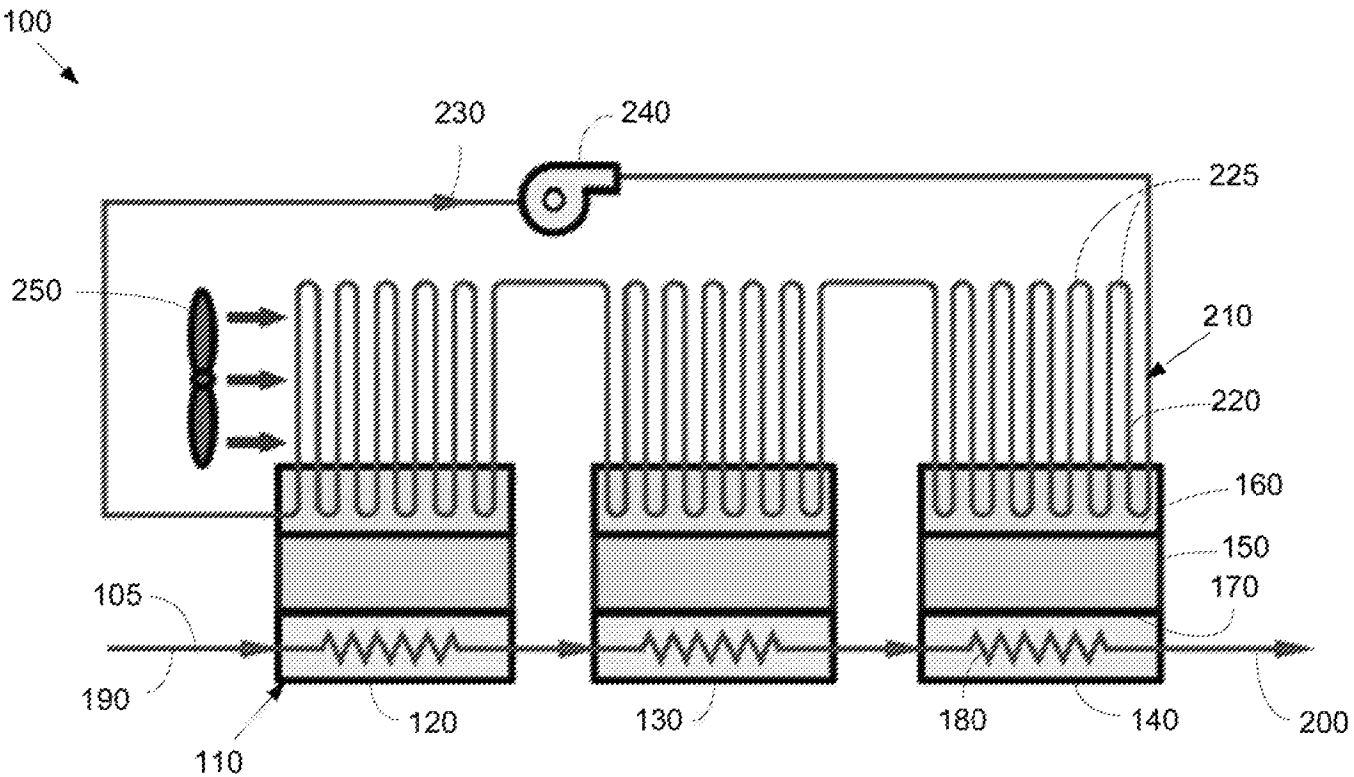
FIG. 1 is a schematic diagram of a beverage cooler with a number of enhanced thermoelectric cooling modules as may be described herein.

Referring now to the drawings, in which like numerals refer to like elements throughout the several views, FIG. 1 shows a schematic diagram of an example of a beverage cooler 100 as may be described herein. The beverage cooler 100 may be used with any type of a fluid 105. The fluid 105 may be a beverage or any or all of the component fluids that make a beverage such as a diluent, a syrup, a concentrate, a sweetener, colors, flavors, and the like. Any type of fluid 105 intended to be chilled may be used herein. By way of example only, water may be used herein as a beverage and an evaporant. The nature of the beverage cooler 100 is in no way limited by the type of fluids flowing herein.

In this example, the beverage cooler 100 may have a number of enhanced thermoelectric cooling modules 110. Although a first enhanced thermoelectric cooling module 120, a second enhanced thermoelectric cooling module 130, and a third enhanced thermoelectric cooling module 140 are shown, any number of the enhanced thermoelectric cooling modules 110 may be used herein. The enhanced thermoelectric cooling modules 110 may be positioned in series as is shown, in parallel, or in any configuration. Moreover, as will be described in more detail below, portions of the thermoelectric cooling modules 140 may arranged in series with other portions arranged in parallel.

Each enhanced thermoelectric cooling module 110 may include a thermoelectric cooling device 150. Each thermoelectric cooling device 150 may include a hot side 160 and a cold side 170. As described above, electric current flowing through the thermoelectric cooling device 150 causes heat to be absorb from the cold side 170 and released on the hot side 160. The thermoelectric cooling device 150 may have any suitable size, shape, or configuration. The thermoelectric cooling device 150 may be in communication with any suitable type of conventional power source.

The enhanced thermoelectric cooling module 110 may include a fluid heat exchanger 180 thermally coupled to the cold side 170 of the thermoelectric cooling device 150. The fluid heat exchanger 180 may have any suitable size, shape, or configuration. The fluid 105 may enter the fluid heat exchanger 180 at a first temperature 190 and leave at a second temperature 200. The second temperature 200 may be lower than the first temperature 190.

The enhanced thermoelectric cooling module 110 may include an evaporative heat sink 210 thermally coupled to the hot side 160 of the thermoelectric cooling device 150. The evaporative heat sink 210 may include a water permeable membrane 220 for evaporative cooling instead of simply air cooling as described above. The water permeable membrane 220 includes a flow of water 230 therethrough. Other types of evaporant fluids and membranes also may be used. The water permeable membrane 220 may be arranged in a series of loops 225 as is shown or in any other type of configuration. The water permeable membrane 220 may be in thermal contact with the hot side 160 of the thermoelectric cooling device 150. The water permeable membrane 220 thus absorbs the heat rejected from the hot side 160 of the thermoelectric cooling device 150. Evaporation of a portion of the flow of water 230 through the water permeable membrane 220 provides cooling to the thermoelectric cooling device 150. Specifically, the rate of heat rejection may be proportional to the difference between the temperature of the hot side 160 and the adiabatic saturation (wet bulb) temperature of the ambient air.

The beverage cooler 100 may include a water pump 240 in communication with the enhanced thermoelectric cooling modules 110. The water pump 240 may be of conventional design and may pump the water 230 through the water permeable membrane 220 within each enhanced thermoelectric cooling module 110. The beverage cooler 100 also may include a fan 250 or other type of air movement device so as to promote the flow of ambient air across the water permeable membranes 220 for efficient evaporation. The fan 250 provides a forced convection airflow therethrough. The flow of fluid 105 may decrease in temperature when flowing through each of the enhanced thermoelectric cooling modules 110. In other words, the flow of fluid 105 may decrease in temperature by X degrees in the first enhanced thermoelectric cooling modules 120, by Y degrees in the second enhanced thermoelectric cooling module 130, and by Z degrees in the third enhanced thermoelectric cooling module 140. The decrease in temperature across each of the enhanced thermoelectric cooling modules may be the same or different so as to reach a desired beverage temperature. Other components and other configurations may be used herein.

Figure 2:
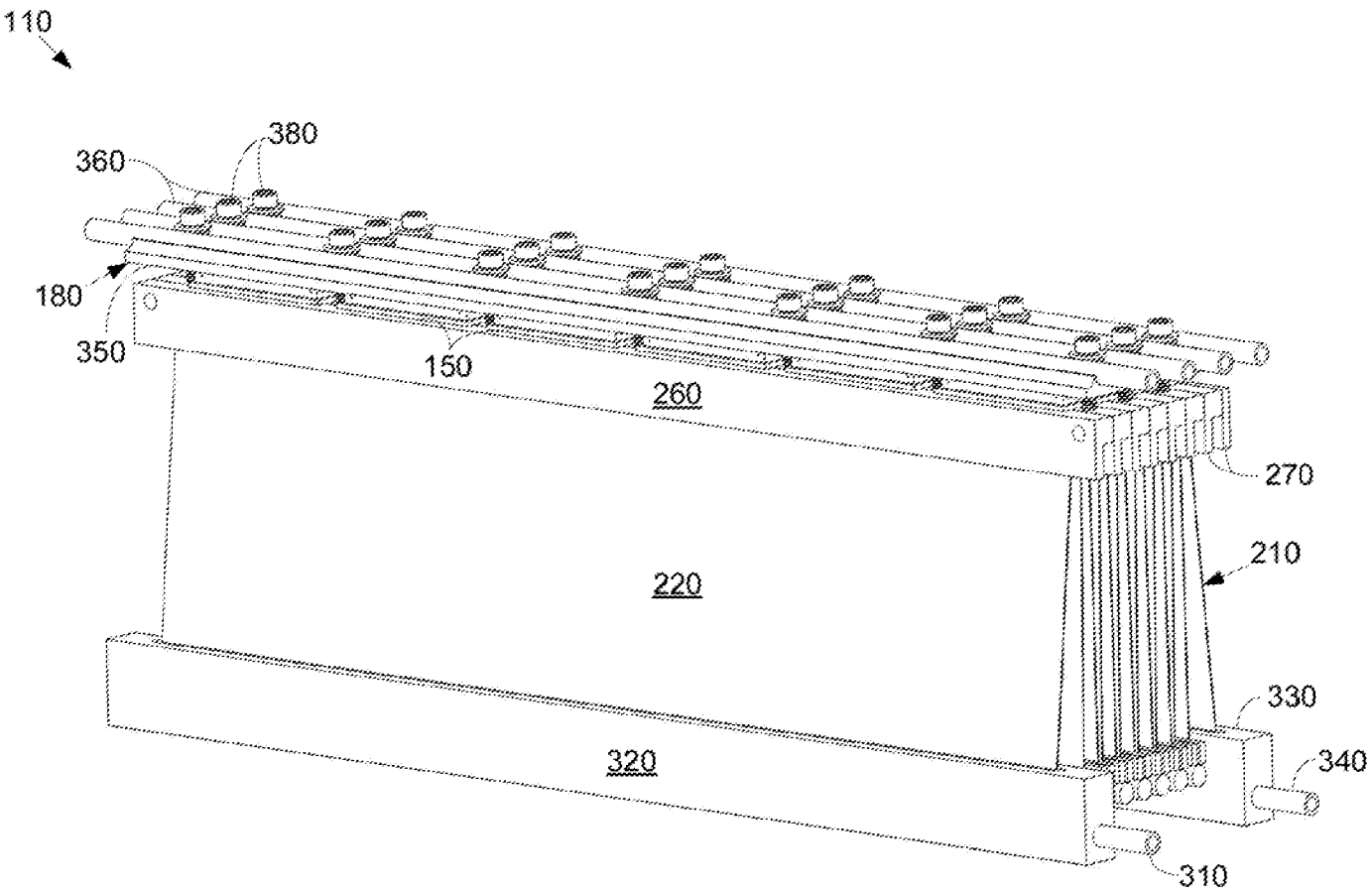
FIG. 2 is a perspective view of an enhanced thermoelectric cooling module.
Figure 3:
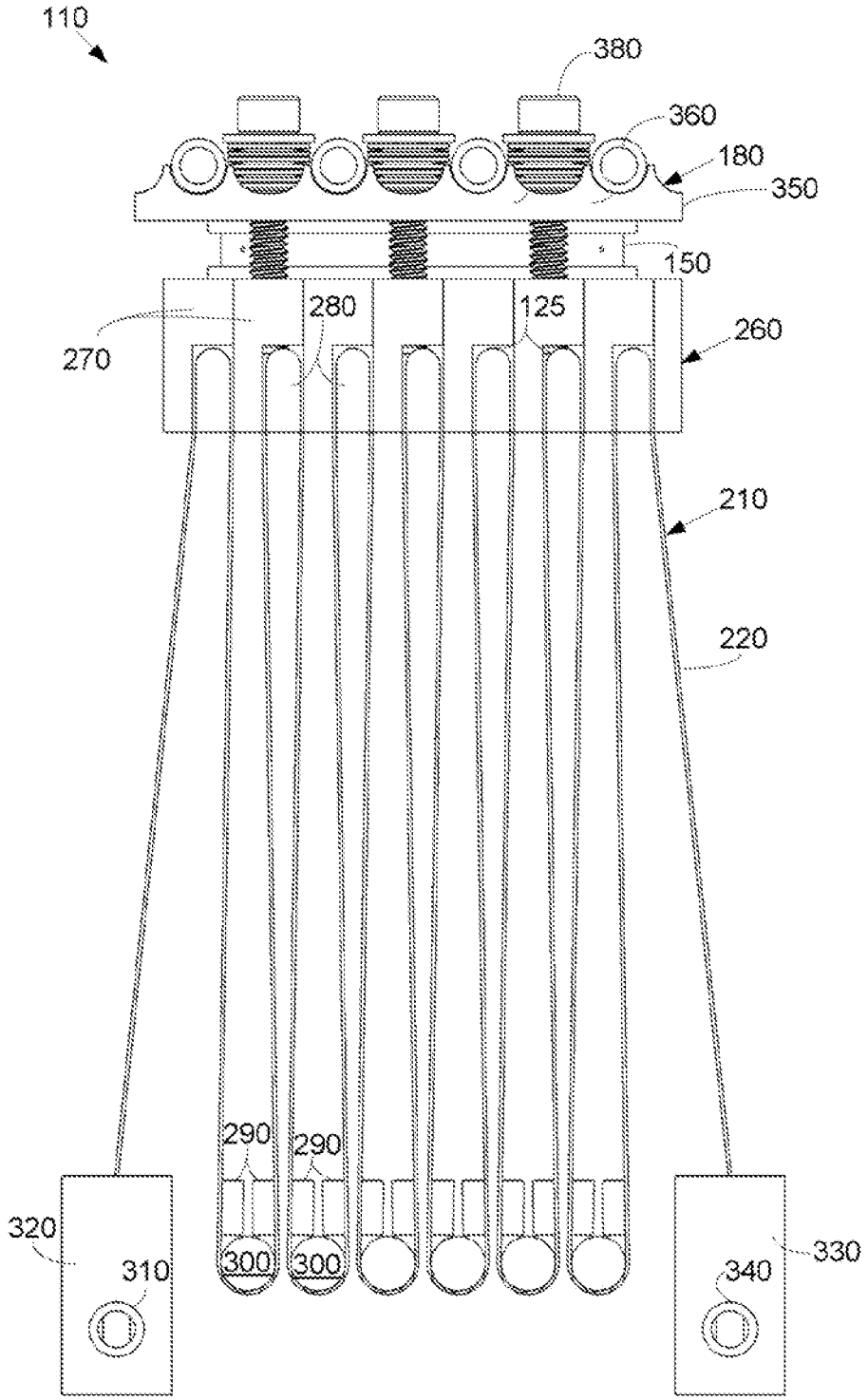
FIG. 3 is a side plan view of the enhanced thermoelectric cooling module of FIG. 2.

FIGS. 2 and 3 show an example of an enhanced thermoelectric cooling module 110. The enhanced thermal cooling module 110 may include a number of the thermoelectric cooling devices 150 with the hot side 160 and the cold side 170. Any number of the thermoelectric cooling devices 150 may be used herein in any configuration. Specifically, the hot side 160 of each thermoelectric cooling device 150 may be positioned about a thermal interface block 260. The thermal interface block 260 may be formed from a number of substantially "L" shaped laminations 270. Any number of the laminations 270 may be used herein in any size, shape, or configuration. The thermal interface block 260 provides for good heat transfer between the hot side 160 of the thermoelectric cooling devices 150 and the water permeable membrane 220. Other components and other configurations may be used herein.

The water permeable membrane 220 may be made out of a hollow fiber mat membrane with a parallel array of small tubes that provide a flow path from an inlet to an outlet. The hollow tubes may be porous hollow fibers. The porous hollow fibers may serve as the warp elements of the mat and may be joined by small fibers as the weft elements. Water may flow through the hollow center of each fiber with a portion of the flow evaporating therein. Other types of evaporative membranes and/or other types of evaporative heat sinks 210 may be used herein.

The ends of the loops 225 of the water permeable membrane 220 may be in contact with the laminations 270 of the thermal interface block 260. The end of each loop 225 may be supported by a U-shaped spacer 280 therein. The spacers 280 may force the water permeable membrane 220 against the surfaces of the laminations 270 so as to ensure good thermal conduct. A conductive epoxy or other suitable bonding medium may be used to hold the water permeable membrane 220 and the spacers 280 in place.

The spacers 280 may provide good thermal contact without excessive compression that may cut off the water flow therein. Given such, smaller radii at the ends of the loops 225 may be desirable because such small radii may increase the number of times the water flows through the thermal interface block 260. Too small of a radius, however, may cause a kink and/or collapse the flow channels therethrough. A radius of about three times the diameter of the fiber has been found to be preferred. By way of example only, a membrane made from a 150 μm diameter fiber may be formed into a U-bend around a 450 μm radius (0.9 millimeter diameter) spacer element. Allowing the fibers to curve around the spacer 280 at an angle relative to the flat face of the spacers 280 thus helps to eliminate kinking. About a 45° angle or so may be effective at enabling the fiber mat membranes to achieve a smaller radius of curvature. Other dimensions and angles may be used herein.

An array of lower spacers 290 may maintain the appropriate spacing between the membrane loops 225 at the end of the membrane 220 that is opposite the thermal interface block 260. The lower spacers 290 may be substantially rectangular in shape although any suitable size, shape, or configuration may be used herein. A number of radius elements 300 may be used to ensure that the loops 225 make the U-bend without kinking or distorting. The radius elements 300 may be largely circular in shape although any suitable size, shape, or configuration may be used herein. Other components and other configurations may be used herein.

The flow of water 230 thus may enter the enhanced thermoelectric cooling module 110 via an inlet tube 310 of an inlet manifold 320. The flow of water 230 may then flow through the loops 225 of the water permeable membrane 220 as cooling air is forced through the array by the fans 250. The air may flow in a substantial perpendicular direction to the membrane sheets. Specifically, the flow of water in the water permeable membrane 220 may pick up heat in the laminations 270 of the thermal interface block 260 and may cool via evaporation on the way to the lower spacers 290 and back. The flow of water 230 flows through the loops 225 several times through the air flow and the thermal interface block 260 before reaching an outlet manifold 330 and an outlet tube 340. Because the concentration of water vapor in the air increases as it flows through the water permeable membrane 220, the direction and quantity of the air flow may have an impact on overall performance. Generally described, the residence time of the air passing through the water permeable membrane 220 may be short enough such that there is still good driving potential for evaporation even in humid conditions. The short residence time may be achieved either through higher air velocity or through shorter path lengths. A shorter path length may be preferred herein as compared to larger or noisier fans 250 or other types of air movement devices. Other components and other configurations may be used herein.

The fluid heat exchanger 180 may be positioned on the cold side 170 of the thermoelectric cooling device 150. The fluid heat exchanger 180 may include a heat spreader 350 positioned in good thermal contact with the cold side 170 of the thermoelectric cooling device 150. The heat spreader 350 may be sized and shaped so as to accommodate a number of beverage tubes 360 therein. The heat spreader 350 thus may have a number of U-shaped groves 370 therein or other types of configurations so as to accommodate the beverage tubes 360 therein and in good thermal contact. Any number of the beverage tubes 360 may be used herein in any suitable size, shape, or configuration. The heat spreader 350 and the beverage tubes 360 may be made out of any substantially rigid material with good heat transfer characteristics. The heat spreader 350 and the beverage tubes 360 may be attached via soldering, brazing, epoxy, and/or any type of conventional bonding techniques. The heat spreader 350 and the beverage tubes 360 may be held in place against the cold side 170 of the thermoelectric cooling device 150 via a number of fasteners 380 and the like. Alternatively, the heat spreader 350 may be permanently attached to the thermoelectric cooling device 150. Other components and other configuration may be used herein.

Figure 4:
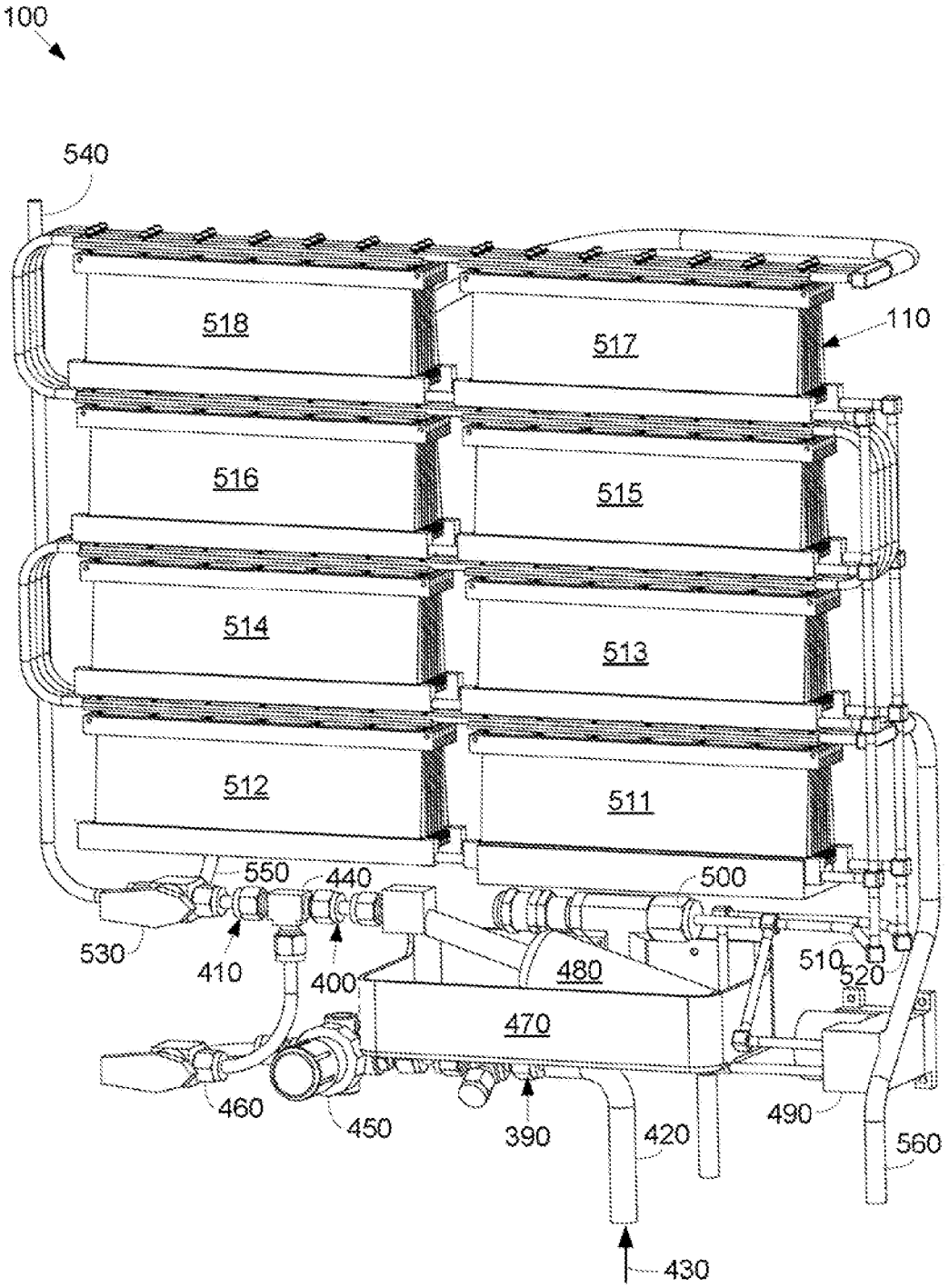
FIG. 4 is a front perspective view of a beverage cooler with a number of enhanced thermoelectric cooling modules.
Figure 5:
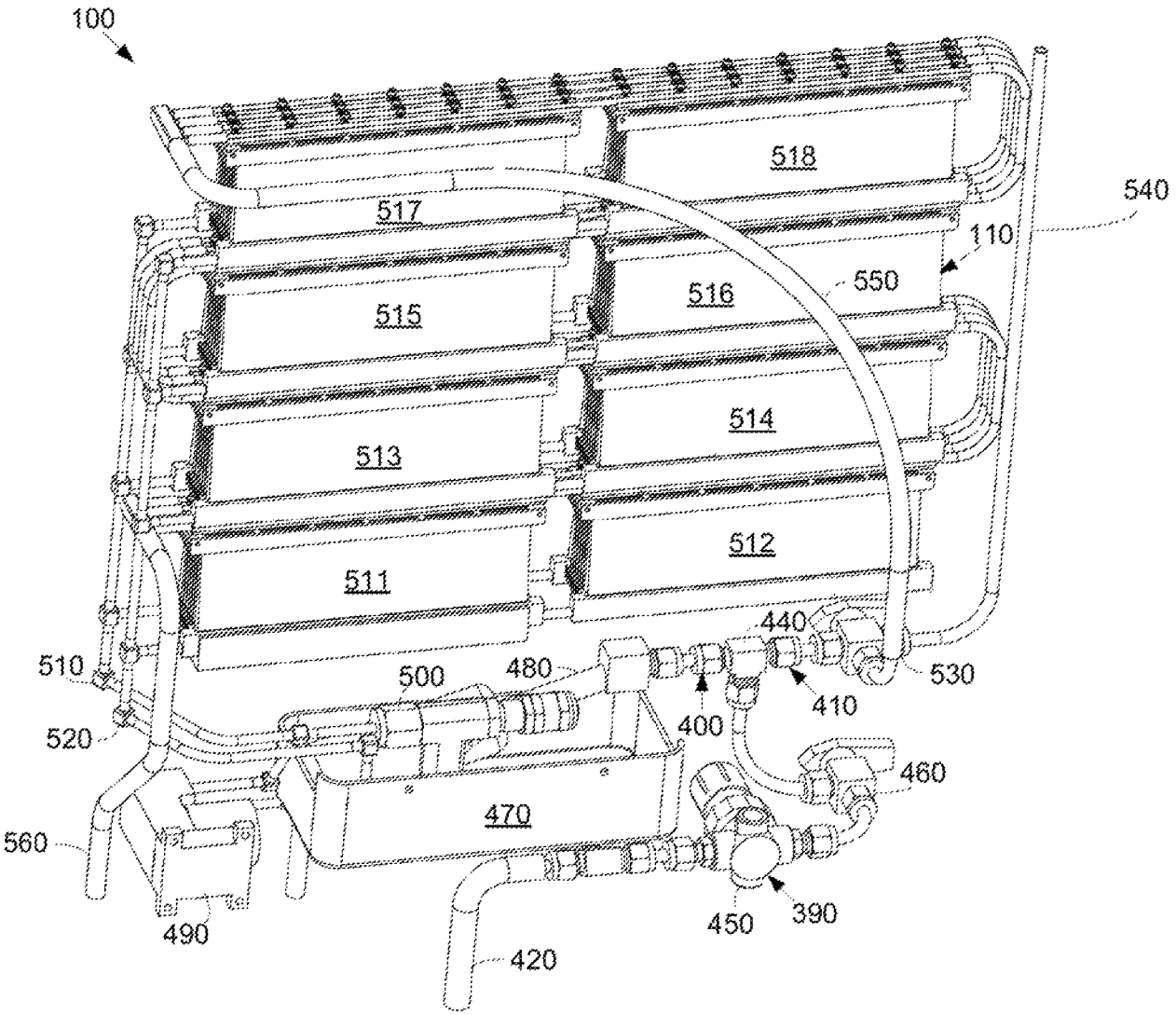
FIG. 5 is a rear perspective view of the beverage cooler of FIG. 4.

FIGS. 4 and 5 show an example of a beverage cooler 100 using a number of the enhanced thermoelectric cooling modules 110. Any number of the enhanced thermoelectric cooling modules 110 may be used herein. The beverage cooler 100 may include a water flow system 390. The water flow system 390 may lead to both an evaporant flow system 400 and a beverage flow system 410. Specifically, the water flow system 390 may include a water inlet 420 with a flow of water 430 therein. Other types of fluids may be used herein. The flow of water 430 may be any pressure. The water inlet 420 may be in communication with a T-fitting 440 or other type of connection via a pressure regulator 450 and a control valve 460. The pressure regulator 450 and the control valve 460 may be of conventional design. The T-fitting 440 leads to the evaporant flow system 400 and the beverage flow system 410. Alternatively, both the evaporant flow system 400 and the beverage flow system 410 may be in communication with a separate flow of water and/or other or different types of fluids. Other components and other configurations may be used herein.

The evaporant flow system 400 may include an evaporant reservoir 470. The flow of the water into the evaporant reservoir 470 may be controlled by a level control 480. The flow of water 430 may fill the reservoir 470 until a preset level is determined by the level control 480. The level control 480 may be of conventional design and may include a float valve and the like. The evaporant flow system 400 also may include an evaporant pump 490 in communication with the evaporant reservoir 470 and a pressure control valve 500. The pressure control valve 500 may be a spring loaded pressure release valve and the like. The pressure control valve 500 limits the pressure on the water permeable membranes 220. The evaporant pump 490 and the pressure control valve 500 may be of conventional design. The evaporant pump 490 may pump the flow of water 430 into a supply manifold 510. The supply manifold 510 may have any suitable size, shape, or configuration. The supply manifold 510 may be in communication with the inlet tubes 310 of the inlet manifolds 320 of the enhanced thermoelectric cooling modules 110.

Specifically, the supply manifold 510 may be in communication with the inlet tube 310 of the inlet manifold 320 of a first enhanced thermoelectric cooling module 511. The first enhanced thermoelectric cooling module 511 may be connected in series with a second enhanced thermoelectric cooling module 512. Likewise, the outlet tube 340 of the first enhanced thermoelectric cooling module 511 may be in communication with a return manifold 520. The return manifold 520 may be in communication with the evaporant reservoir 470. The return manifold 520 may have any suitable size, shape, or configuration. In a similar manner, the supply manifold 510 and the return manifold 520 may be in communication with a second pair of modules including a third enhanced thermoelectric cooling module 513 and a fourth enhanced thermoelectric cooling module 514; a third pair of a fifth enhanced thermoelectric cooling module 515 and a sixth enhanced thermoelectric cooling module 516; and a fourth pair of a seventh enhanced thermoelectric cooling module 517 and an eighth enhanced thermoelectric cooling module 518. Any number of enhanced thermoelectric cooling modules 110 may be used herein in any suitable order or configuration.

As the flow of water 430 evaporates within the enhanced thermoelectric cooling modules 110, the level of the water 430 within the evaporator reservoir 470 will drop and more water may be added via the level control 480. The pressure control valve 500 may control the pressure at the inlet of the enhanced thermoelectric cooling modules 110 by diverting part of the pump flow directly back to the evaporant reservoir 470. The evaporant reservoir 470 may be positioned underneath each of the enhanced thermoelectric cooling modules 110 such that the flow of water 430 may drain back into the reservoir 470 when the pump 490 is not in use. Other components and other configurations may be used herein.

The beverage flow system 410 extends from the other end of the T-fitting 440. The beverage flow system 410 may include a three-way valve 530. The three way valve 530 may be of conventional design. The three-way valve 530 may be in communication with a stand pipe 540. The stand pipe 540 may provide a vent such that the overall beverage cooler 500 may be drained of water following use. The other end of the three-way valve 530 may be in communication with a beverage intake line 550. The beverage intake line 550 may be in communication with the beverage tubes 360 of the top fluid heat exchanger 180 or, in this example, the seventh enhanced thermoelectric cooling modules 517. The beverage tubes 360 of each enhanced thermoelectric cooling module 110 may be connected in series such that the flow of water 430 flows through the seventh enhanced thermoelectric cooling module 517, to the eight enhanced thermoelectric cooling module 518, to the sixth enhanced thermoelectric cooling module 516, to the fifth enhanced thermoelectric cooling module 515, to the third enhanced thermoelectric cooling module 513, to the fourth enhanced thermoelectric cooling module 514, to the second enhanced thermoelectric cooling module 512, and to the first enhanced thermoelectric cooling module 511. The flow of water 430 then may flow through a delivery tube 560 and out of the beverage cooler 100. The flow of water 430 losses heat in each of the enhanced thermoelectric cooling modules 110 and becomes progressively cooler until the desired beverage temperature is reached. Other components and other configuration may be used herein.

Figure 6:
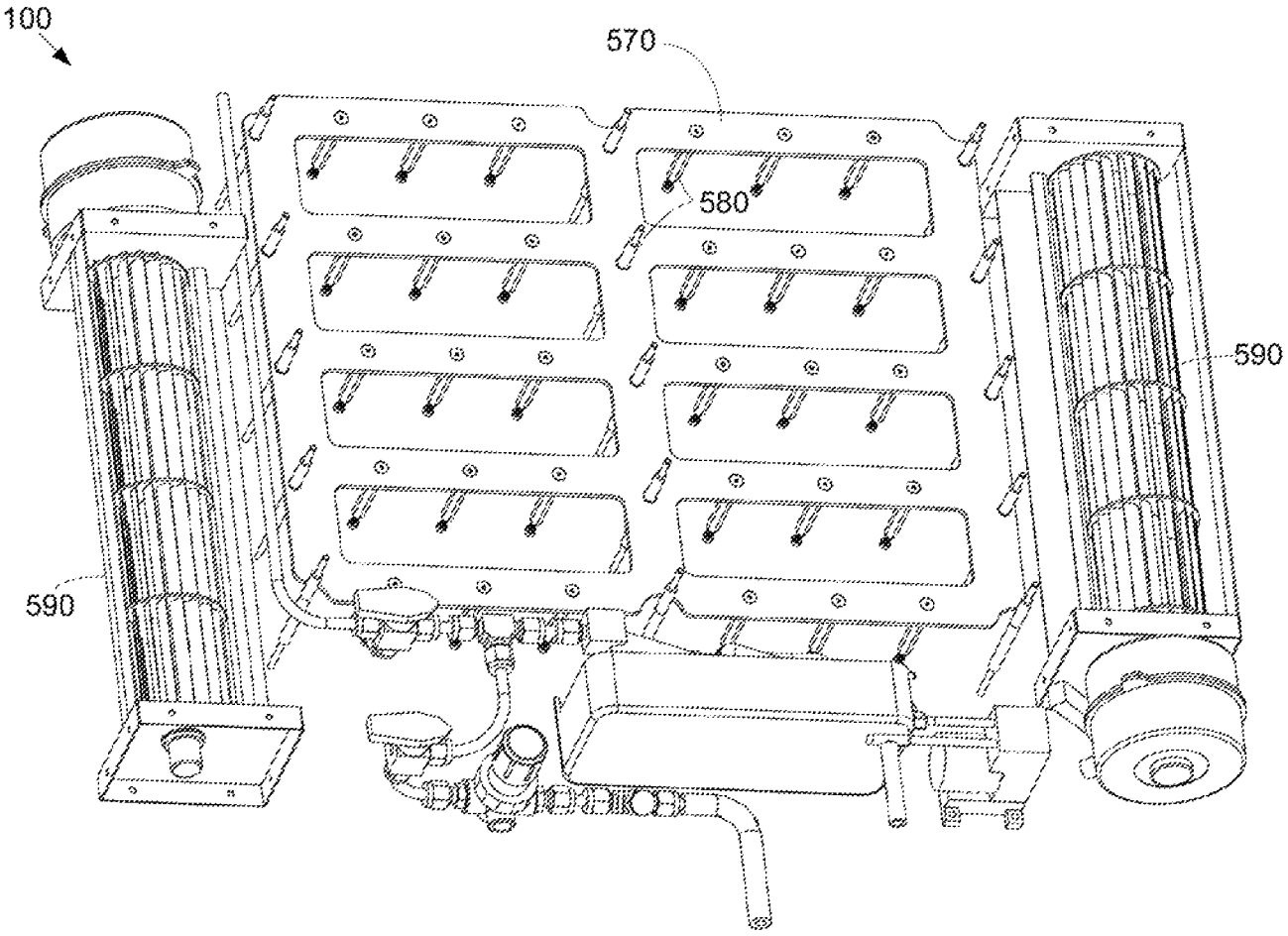
FIG. 6 is a front perspective view of an internal frame and fans of the beverage cooler of FIG. 4.
Figure 7:
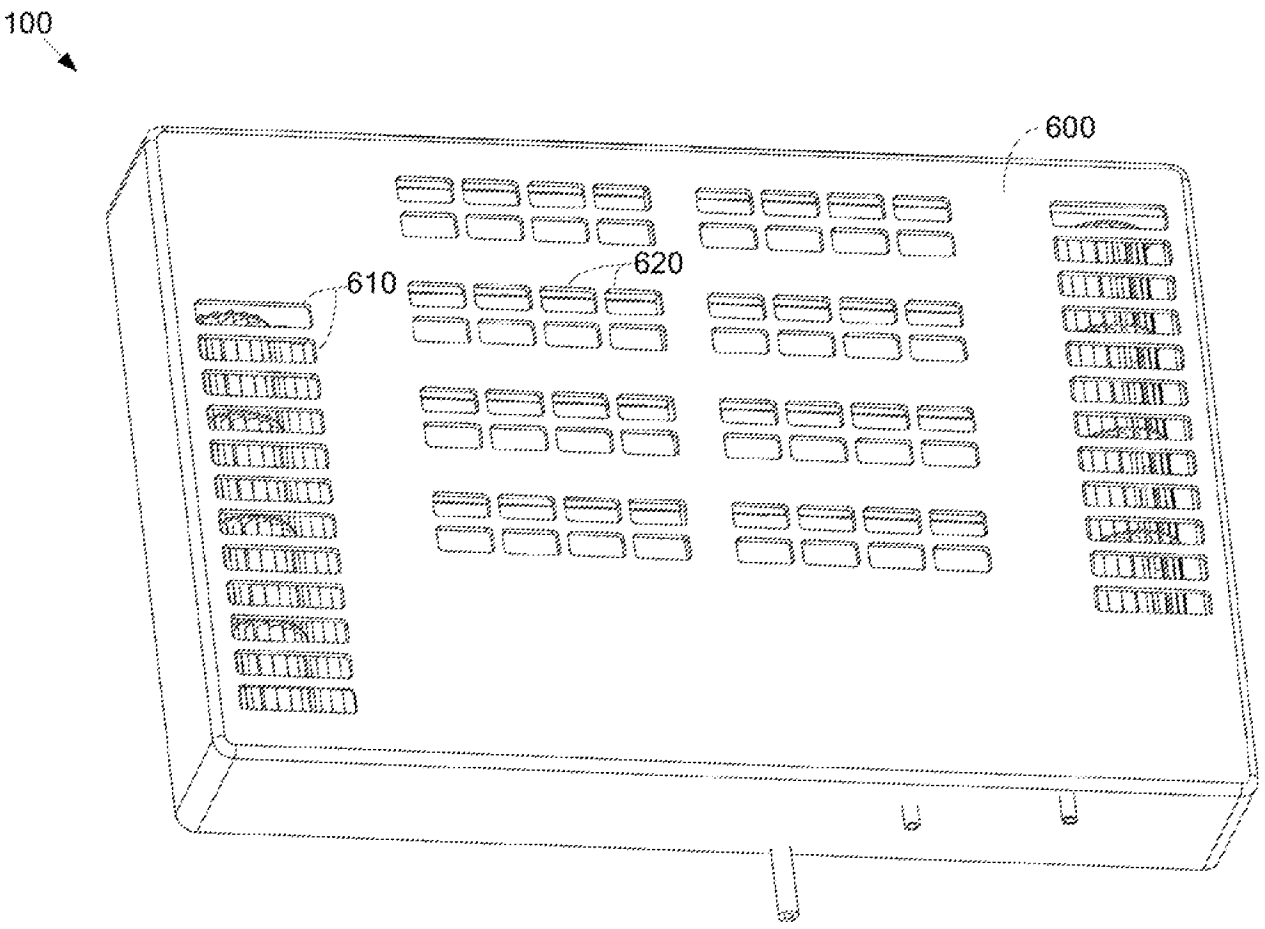
FIG. 7 is a front perspective view of an outer frame of the beverage cooler of FIG. 4.

FIG. 6 shows a perspective view of an inner support frame 570 of the beverage cooler 100. The inner support frame 570 may have a number of stand offs 580 or other structures so as to position and support each of the enhanced thermoelectric cooling modules 110 therein. The inner support frame 570 may have any suitable size, shape, or configuration. One or more fans 590 may be positioned about the inner support frame 570 so as to provide a flow of cooling air to the enhanced thermoelectric cooling modules 110. Any type of air movement device may be used herein. As is shown in FIG. 7, the beverage cooler 100 also may include an outer frame 600. The outer frame 600 may have of any suitable size, shape, or configuration. The outer frame 600 may have a number of inlet vents 610 and outlet vents 630 so as to provide a flow of air therethrough. Other components and other configurations may be used herein.

Figure 8:
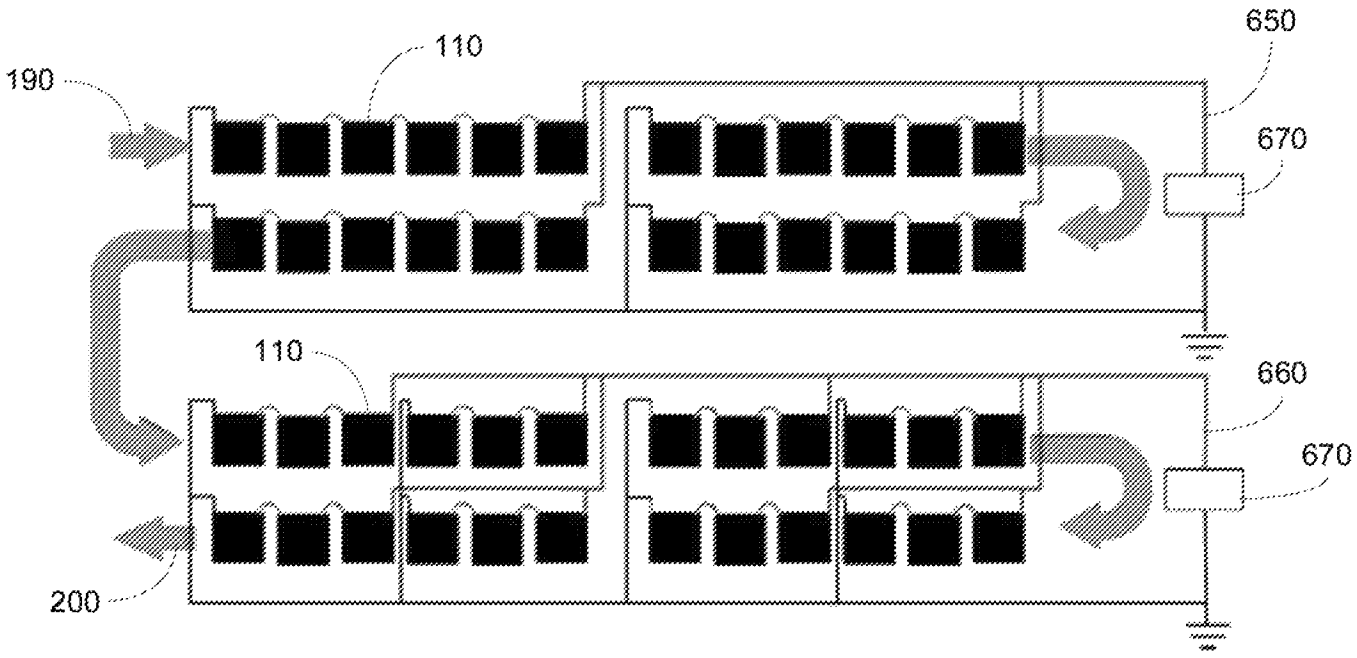
FIG. 8 is a schematic diagram of a power arrangement for the beverage cooler of FIG. 4.

FIG. 8 shows a schematic diagram of an example of how to power the enhanced thermoelectric cooling modules 110. In this example, the enhanced thermoelectric cooling modules 110 may be positioned within a first bank 650 and a second bank 660. The first bank 650 may chill the incoming water stream 430 to an intermediate temperature while the second bank 660 may chill the water from the intermediate temperature to the desired beverage temperature. Because overall thermoelectric cooling operating characteristics depend on the cold side temperature, the two banks may be wired differently so as to provide optimized operating conditions for each chilling temperature. For example in the first bank 650, the enhanced thermoelectric cooling modules 110 may be divided into four groups of six modules that are connected in parallel to a power source 670. This configuration provides lower voltage and higher current. In the second bank 660, the enhanced thermoelectric cooling modules 110 may be divided into eight groups of three that may be connected in parallel. This arrangement provides higher voltage to the enhanced thermoelectric cooling modules that must cool the water at lower temperatures. Many other configurations may be used herein.

The beverage cooler 100 may be used to provide either continuous cooling to a fluid stream or very rapid chilling of a single serving. The beverage cooler 100 may provide continuous chilling to the fluid stream and may be limited only by the steady state cooling capabilities of the enhanced thermoelectric cooling modules 110 and the heat/mass transfer characteristic of the evaporators and beverage heat exchangers. Alternatively, the beverage cooler 100 may provide very rapid chilling for a single serving of a beverage. This mode of operation may rely upon the very rapid cooling capabilities of the enhanced thermoelectric cooling modules 110 and the thermal storage capability of the thermal interface blocks 260. Specifically, the beverage tubes 360 extending through the beverage heat exchanger 180 may hold enough water for a single beverage serving. Given such, the enhanced thermoelectric cooling modules 110 may chill the water therein. The modules may absorb heat by warming up gradually from ambient temperature. The inherent thermal mass of the heat exchangers therein may limit the rate of the temperature rise.

Because the heat exchangers would be cooler during this process than during steady state chilling, the amount of refrigeration provided by the enhanced thermoelectric cooling modules 110 may be greater in this transient mode than during steady state operation. When the beverage has reached the desired temperature, the beverage may be rapidly drained via the delivery tube 560. Other components and other configurations may be used herein.

The beverage cooler 100 thus may provide a beverage at significant lower temperatures as compared to conventional thermoelectric devices. Cooling based on the ambient wet bulb temperature thus provides these benefits because the adiabatic saturation temperature is always lower than the ambient dry bulb temperature. Given such, the enhanced thermoelectric cooling modules 110 may reduce the hot side temperature relative to a conventional device. Specifically, lower overall temperatures may be reached by reducing the temperature of the hot side. Likewise, reducing the hot side temperature may limit backwards thermal conduction across the modules 110 so as to increase the amount of refrigeration generated per power unit. The result may be higher coefficients of performance as compared to conventional devices.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof

We claim:

1. A cooler for cooling a beverage fluid flow, comprising:

a thermoelectric cooling device;

the thermoelectric cooling device in communication with a fluid heat exchanger with the fluid flow therein and a fluid permeable membrane for evaporative cooling therein; and a fan positioned about the fluid permeable membrane.

2. The cooler of claim 1, wherein the fluid permeable membrane comprises a plurality of loops in communication with the thermoelectric cooling device.

3. The cooler of claim 1, wherein the thermoelectric cooling device comprises a cold side in communication with the fluid heat exchanger and a hot side in communication with the fluid permeable membrane.

4. The cooler of claim 1, further comprising a thermal interface block in communication with the thermoelectric cooling device and the fluid permeable membrane.

5. The cooler of claim 4, wherein the thermal interface block comprises a plurality of laminations in communication with the fluid permeable membrane.

6. The cooler of claim 4, wherein the thermal interface block comprises a plurality of U-shaped spacers in communication with the fluid permeable membrane.

7. The cooler of claim 1, wherein the fluid permeable membrane comprises a porous hollow fiber membrane.

8. The cooler of claim 1, wherein the fluid heat exchanger comprises a heat spreader in communication with the thermoelectric cooling device.

9. The cooler of claim 1, wherein the fluid heat exchanger comprises a plurality of beverage tubes with the beverage fluid flow therein.

10. The cooler of claim 1, wherein the thermoelectric cooling device, the beverage heat exchanger, and the fluid permeable membrane comprise a thermoelectric cooling module and wherein the cooler comprises a plurality of thermoelectric cooling modules.

11. The cooler of claim 10, further comprising an evaporant flow system and a beverage flow system in communication with the plurality of thermoelectric cooling modules.

12. The cooler of claim 11, wherein the evaporant flow system comprises an evaporant reservoir and an evaporant pump in communication with a flow of evaporant fluid.

13. The cooler of claim 12, wherein the evaporant flow system comprises a supply manifold and a return manifold in communication with the flow of evaporant fluid and the fluid permeable membrane of each of the plurality of thermoelectric cooling modules.

14. The cooler of claim 1, wherein the fluid heat exchangers of the plurality of thermoelectric cooling modules are positioned in series and wherein a number of the fluid permeable membranes of the plurality of thermoelectric cooling modules are positioned in parallel.

15. A method of cooling a fluid, comprising:

flowing the fluid on a cold side of a thermoelectric cooling device;

flowing an evaporant through a water permeable membrane on a hot side of the thermoelectric cooling device to pull heat therefrom;

blowing air across the water permeable membrane; and pulling heat from the fluid across the thermoelectric cooling device.

16. A beverage cooler for cooling a beverage fluid flow, comprising:

a plurality of thermoelectric cooling modules;

each of the plurality of thermoelectric cooling modules comprising a water permeable membrane;

a pump in communication with the plurality of thermoelectric cooling modules; and a fan positioned about the plurality of thermoelectric cooling modules.

17. The beverage cooler of claim 16, wherein each of the thermoelectric cooling modules comprises a thermoelectric cooling device with a cold side in communication with the beverage fluid flow and a hot side in communication with the water permeable membrane.

18. The beverage cooler of claim 16, wherein the water permeable membrane comprises a porous hollow fiber membrane.

19. The beverage cooler of claim 16, further comprising an evaporant flow system and a beverage flow system in communication with the plurality of thermoelectric cooling modules.

20. The beverage cooler of claim 16, wherein the plurality of thermoelectric cooling modules comprise fluid heat exchanger positioned in series and wherein a number of the water permeable membranes of the plurality of thermoelectric cooling modules are positioned in parallel.

* * * * *